US007427230B2

(12) United States Patent
Blake et al.

(10) Patent No.: US 7,427,230 B2
(45) Date of Patent: Sep. 23, 2008

(54) RESILIENT PAD FOR DISC-TYPE COIN PROCESSING DEVICE

(75) Inventors: John R. Blake, St. Charles, IL (US); David J. Wendell, Willow Springs, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 60 days.

(21) Appl. No.: 11/009,728

(22) Filed: Dec. 10, 2004

(65) Prior Publication Data

US 2006/0148394 A1 Jul. 6, 2006

(51) Int. Cl.

| | |
|---|---|
| ***G07D 1/00*** | (2006.01) |
| ***G07D 9/00*** | (2006.01) |
| ***G07D 9/08*** | (2006.01) |
| ***G07F 9/08*** | (2006.01) |

(52) U.S. Cl. ..... 453/63; 453/49; 453/57; 194/342

(58) Field of Classification Search ..... 453/63, 453/3, 4, 5, 9, 12, 13, 18, 29, 30, 33, 49, 453/57; 194/302, 334, 342; 209/552, 652; 221/259; 414/797.3, 195

See application file for complete search history.

(56) References Cited

U.S. PATENT DOCUMENTS 5,474,495 A * 12/1995 Geib et al. ..... 453/3
5,538,468 A * 7/1996 Ristvedt et al. ..... 453/3

* cited by examiner

*Primary Examiner*—Patrick Mackey
*Assistant Examiner*—Mark J. Beauchaine
(74) *Attorney, Agent, or Firm*—Nixon Peabody LLP

(57) ABSTRACT

A resilient pad for a disc-type coin processing machine is provided with a first portion with a property having a first value and a second portion with the property having a second value, wherein the first value of the property is different than the second value of the property. The property may include, for example, stiffness or coefficient of friction.

26 Claims, 8 Drawing Sheets

RESILIENT PAD FOR DISC-TYPE COIN PROCESSING DEVICE

FIELD OF THE INVENTION

The present invention relates generally to coin processing devices and, more particularly, to a disc-type coin processing device and to a resilient pad for a disc-type coin processing device.

BACKGROUND OF THE INVENTION

Generally, disc-type coin sorters sort coins according to the diameter of each coin. Typically, in a given coin set such as the United States coin set, each coin denomination has a different diameter. Thus, sorting coins by diameter effectively sorts the coins according to denomination.

Disc-type coin sorters typically include a resilient pad (disposed on a rotating disc) that rotates beneath a stationary sorting head having a lower surface positioned parallel to the upper surface of the resilient pad and spaced slightly therefrom. The rotating, resilient pad presses coins upward against the sorting head as the pad rotates. The conventional resilient pad comprises an open-cell sponge rubber material having a thin fabric finish surface sheet or protective layer attached to an upper surface thereof with an adhesive agent applied to a backside of the resilient pad for attachment to an underlying disc.

The lower surface of the stationary sorting head includes a plurality shaped regions including exit channels for manipulating and controlling the movement of the coins. Each of the exit channels is dimensioned to accommodate coins of a different diameter for sorting the coins based on diameter size. As coins are discharged from the sorting head via the exit channels, the sorted coins follow respective coin paths to sorted coin receptacles where the sorted coins are stored.

It is desirable in the sorting of coins to discriminate between valid coins and invalid coins. Use of the term "valid coin" refers to coins of the type to be sorted. Use of the term "invalid coin" refers to items being circulated on the rotating disc that are not one of the coins to be sorted. One type of conventional disc-type coin sorter includes a discrimination sensor disposed within each exit channel for discriminating between valid and invalid coins as coins enter the exit channels. An invalid coin having a diameter enabling it to pass into an exit channel is detected by the discrimination sensor and a braking mechanism is triggered to stop the rotating disc to clear the invalid coin from the exit channel. A diverter is positioned to divert of the invalid coin to an invalid coin receptacle and the sorting head is then jogged (electronically pulsed) to incrementally rotate and thereby bias the invalid coin into the diverter, where it is passed to the invalid coin receptacle. The diverter is returned to its initial position and the coin sorter is restarted.

To overcome the drawbacks associated with the above-noted conventional disc-type coin sorter, including the downtime attributable to the stopping, jogging and restarting of the rotatable disc to remove invalid coins (about five seconds per invalid coin), the present Applicants co-invented a disc-type coin sorter capable of discriminating coins at a high-rate of speed. This sorter is published as U.S. Pat. No. 6,775,730 entitled "Disc-Type Coin Processing Device Having Improved Coin Discrimination System," issued on Jun. 29, 2004, which is incorporated herein by reference in its entirety.

Additional improvements in the control and/or management of coins in the high-speed disc-type coin processing machine as they are circulated at high speed may provide still further benefits.

SUMMARY OF THE INVENTION

In one aspect, there is provided a resilient pad for a disc-type coin processing machine including a first portion of the resilient pad having a first property and a second portion of the resilient pad having a second property, wherein the second property is different than the first property.

In another aspect, there is provide a resilient pad for a disc-type coin processing machine including a first portion comprising a first bulk or surface property and a second portion of the resilient pad comprising a second bulk or surface property, wherein the second bulk or surface property is different than the first bulk or surface property. In various non-limiting examples, the bulk property may comprise a stiffness or modulus and the surface property may comprise a coefficient of friction.

In another aspect, there is provided a resilient pad for a disc-type coin processing machine including a central portion having a first thickness and an outer peripheral portion having, over at least a portion thereof, a second thickness greater than the first thickness, wherein the central portion and outer peripheral portion of the resilient pad comprises at least one of a rubber, an elastomer, and a polymer.

In another aspect, a coin processing machine for processing a plurality of coins of mixed denominations, includes a stationary sorting head having a lower surface generally parallel to and spaced slightly away from a rotatable disc, the lower surface of the stationary sorting head forming a queuing channel and a coin exit station, the queuing channel having an interior wall against which the coins abut, the queuing channel having a first segment for receiving coins and aligning the coins along the interior wall and a second segment for moving the coins to an outer periphery of the sorting head such that a portion of each coin extends beyond the outer periphery. A rotatable disc for imparting motion to the plurality of coins is also provided and includes a resilient pad with a central portion and an outer annular portion, the outer annular portion having at least a first portion having a higher stiffness than the central portion, the higher stiffness of the first portion providing a higher gripping force on coins disposed between the first portion of the resilient pad and the lower surface of the stationary sorting head than between the central portion of the resilient pad and the lower surface of the stationary sorting head. A sensor is disposed outside the periphery of the sorting head to obtain information from the portion of each coin extending beyond the periphery of the sorting head.

In yet another aspect, a coin processing machine for processing a plurality of coins of mixed denominations includes a rotatable disc for imparting motion to the plurality of coins, the rotatable disc including a resilient pad with a central portion and an outer peripheral portion, the outer peripheral portion having a first portion having a higher stiffness than the central portion, and a stationary sorting head having a lower surface generally parallel to and spaced slightly away from the rotatable disc. The lower surface of the sorting head forms a coin path leading to a coin exit station at which coins are discharged, the coin path moving the coins toward an outer periphery such that a portion of each coin extends beyond the outer periphery, while engaging the first portion of the rotatable disc. A sensor is also disposed outside the periphery of the sorting head for obtaining information from the portion of each coin extending beyond the periphery of the sorting head.

Another aspect of a coin processing machine for processing a plurality of coins of mixed denominations includes a rotatable disc for imparting motion to the plurality of coins, the rotatable disc including a substantially rigid disc having a resilient pad disposed thereupon and a stationary sorting head having a lower surface opposing and spaced apart from the rotatable disc, the lower surface of the sorting head having features forming a coin for biasing coins to an outer periphery of the sorting head such that a portion of the coins extends beyond the outer periphery of the sorting head in at least a sensing area having a coin sensor. A removable member having a dynamic coefficient of friction higher than that of the surrounding portions of the stationary head lower surface is also provided.

A method of processing coins in accord with the present concepts includes the steps of receiving the coins in a coin receiving region, imparting motion to the coins with a rotatable disc having a resilient pad with a central portion and an outer peripheral portion, one or more portions of the outer peripheral portion having a higher stiffness than the central portion, and engaging the coins with a stationary sorting head during the step of imparting motion. The method also includes the steps of moving coins along a coin path within the stationary sorting head to a registering area adjacent a periphery of the sorting head, and gripping, in the registering area, at least a portion of each coin between the stationary sorting head and the one or more portions of the outer peripheral portion having a higher stiffness than the central portion.

The above summary of the present invention is not intended to represent each embodiment, or every aspect, of the present invention. Additional features and benefits of the present invention will become apparent from the detailed description, figures, and claims set forth below.

Figure 1:
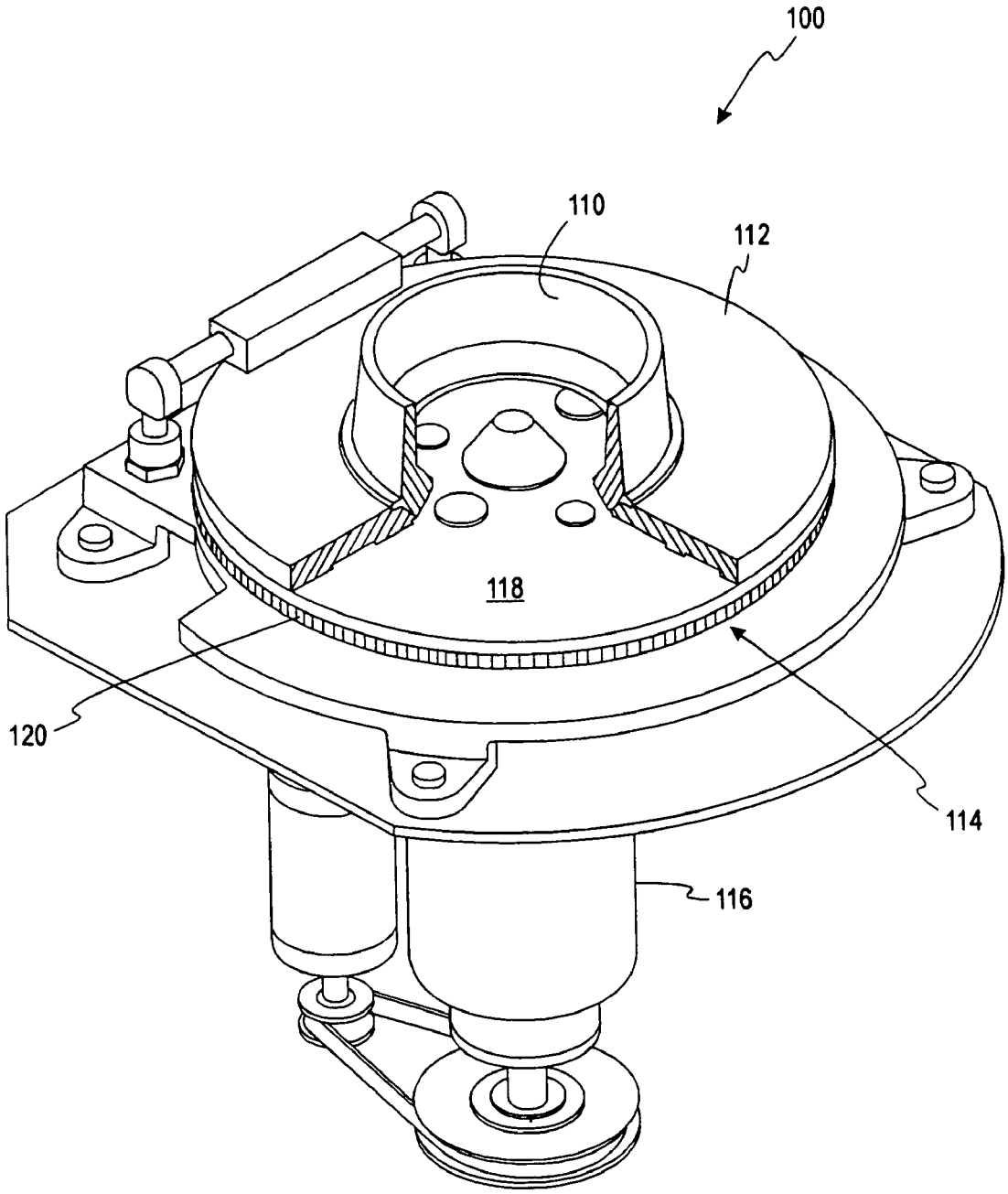
FIG. 1 is a perspective view of a coin processing system, according to one embodiment of the present invention, with portions thereof broken away to show the internal structure.

While the invention is susceptible to various modifications and alternative forms, specific embodiments will be shown by way of example in the drawings and will be desired in detail herein. It should be understood, however, that the invention is not intended to be limited to the particular forms disclosed. Rather, the invention is to cover all modifications, equivalents and alternatives falling within the spirit and scope of the invention as defined by the appended claims.

DETAILED DESCRIPTION OF THE ILLUSTRATED EMBODIMENTS

In accord with the present concepts, there is provided a resilient pad and combinations of a resilient pad and other components, such as a protective layer, useful for a disc-type coin processing machine. This resilient pad and/or combinations thereof having different properties in different portions thereof to provide improvements in and/or better manage the coin handling characteristics of the coin processing machine over at least a portion of the coin travel path.

Turning now to the drawings and referring first to FIG. 1, a disc-type coin processing system 100 in which resilient pads in accord with the present concepts may be advantageously implemented. The coin processing system 100 includes a hopper 110 for receiving coins of mixed denominations that feeds the coins through a central opening in a stationary sorting head 112. As the coins pass through this opening, they are deposited on the top surface of a rotatable disc 114. This rotatable disc 114 is mounted for rotation on a shaft (not shown) and driven by a motor 116. The disc 114 typically comprises a resilient pad 118 attached to the top surface of a disc 120.

The disc 120 may be solid or may comprise openings, channels, and/or spaces to reduce a mass of the disc without a significant reduction in the overall stiffness of the disc 120. While the disc 120 is often made of a metal or alloy, in one or more sections or components, it can also be made of a rigid or substantially rigid polymeric material or a composite material. In another aspect of the present concepts, the bulk modulus, or compressibility, of the disc 120 material may be selectively varied, such as by selection of different materials, components, or configurations.

According to one embodiment, coins are initially deposited by a user in a coin tray (not shown) disposed above the coin processing system 100 shown in FIG. 1. The user lifts the coin tray which funnels the coins into the hopper 110. A coin tray suitable for use in connection with the coin processing system 100 is described in detail in U.S. Pat. No. 4,964,495 entitled "Pivoting Tray For Coin Sorter," which is incorporated herein by reference in its entirety.

As the disc 114 is rotated, the coins deposited on the resilient pad 118 tend to slide outwardly over the surface of the resilient pad 118 due to centrifugal force. As the coins move outwardly, those coins which are lying flat on the resilient pad 118 enter the gap between the surface of the resilient pad 118 and the stationary sorting head 112 because the underside of the inner periphery of the sorting head 112 is spaced above the resilient pad 118 by a distance which is about the same as the thickness of the thickest coin. As is further described below, the coins are processed and sent to exit stations where they are discharged. The coin exit stations may sort the coins into their respective denominations and discharge the coins from exit channels in the sorting head 112 corresponding to their denominations.

Figure 2:
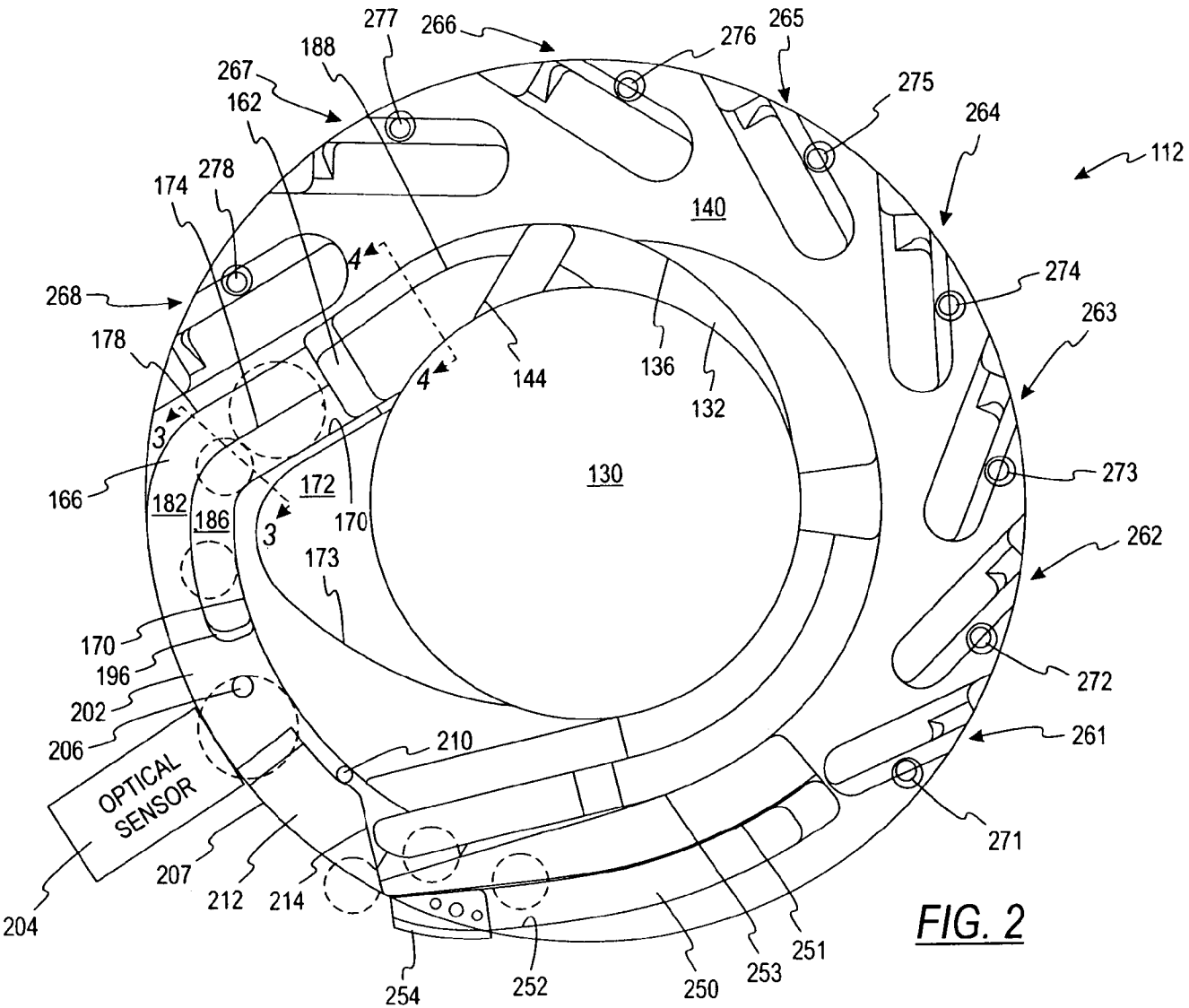
FIG. 2 is an enlarged bottom view of a sorting head for use with the system of FIG. 1.

Referring now to FIG. 2, the underside of the stationary sorting head 112 is shown. The coin sets for any given country are sorted by the sorting head 112 due to variations in the diameter size. The coins circulate between the sorting head 112 and the resilient pad 118 (FIG. 1) on the rotatable disc 114 (FIG. 1). The coins are deposited on the resilient pad 118 via a central opening 130 and initially enter the entry channel 132 formed in the underside of the sorting head 112. It should be keep in mind that the circulation of the coins in FIG. 2 appears counterclockwise as FIG. 2 is a view of the underside of the sorting head 112.

An outer wall 136 of the entry channel 132 divides the entry channel 132 from the lowermost surface 140 of the sorting head 112. The lowermost surface 140 is preferably spaced from the resilient pad 118 by a distance that is slightly less than the thickness of the thinnest coins. Consequently, the initial outward radial movement of all the coins is terminated when the coin engage the outer wall 136, although the coins continue to move more circumferentially along the wall 136 (in the counterclockwise directed as viewed in FIG. 2) by the rotational movement imparted to the coins by the resilient pad 118 of the rotatable disc 114.

In some cases, coins may be stacked on top of each other—commonly referred to as "stacked" coins or "shingled" coins. Some of these coins, particularly thicker coins, will be under pad pressure and cannot move radially outward toward wall 136 under the centrifugal force. Stacked coins which are not against wall 136 must be recirculated and stacked coins in contact against wall 136 must be unstacked. To unstack the coins, the stacked coins encounter a stripping notch 144 whereby the upper coin of the stacked coins engages the stripping notch 144 and is channeled along the stripping notch 144 back to an area of the resilient pad 118 disposed below the central opening 130 where the coins are then recirculated. The vertical dimension of the stripping notch 144 is slightly less the thickness of the thinnest coins so that only the upper coin is contacted and stripped. While the stripping notch 144 prohibits the further circumferential movement of the upper coin, the lower coin continues moving circumferentially across stripping notch 144 into the queuing channel 166.

Stacked coins that may have bypassed the stripping notch 144 by entering the entry channel 132 downstream of the stripping notch 144 are unstacked after the coins enter the queuing channel 166 and are turned into an inner queuing wall 170 of the queuing channel 166. The upper coin contacts the inner queuing wall 170 and is channeled along the inner queuing wall 170 while the lower coin is move by the resilient pad 118 across the inner queuing wall 170 into the region defined by surface 172 wherein the lower coin engages a wall 173 and is recirculated. Other coins that are not properly aligned along the inner queuing wall 170, but that are not recirculated by wall 173, are recirculated by recirculating channel 173.

As the resilient pad 118 continues to rotate, those coins that were initially aligned along the wall 136 (and the lower coins of stacked coins moving beneath the stripping notch 144) move across the ramp 162 leading to the queuing channel 166 for aligning the innermost edge of each coin along an inner queuing wall. In addition to the inner queuing wall 170, the queuing channel 166 includes a first rail 174 and a second rail 178 that form the outer edges of stepped surfaces 182 and 186, respectively. The stepped surfaces 182, 186 are acutely angled with respect to the horizontal. The surfaces 182 and 186 are sized such that the width of surface 182 is less than that of the smallest (in terms of the diameter) coins and the width of surface 184 is less than that of the largest coin.

Figure 3:
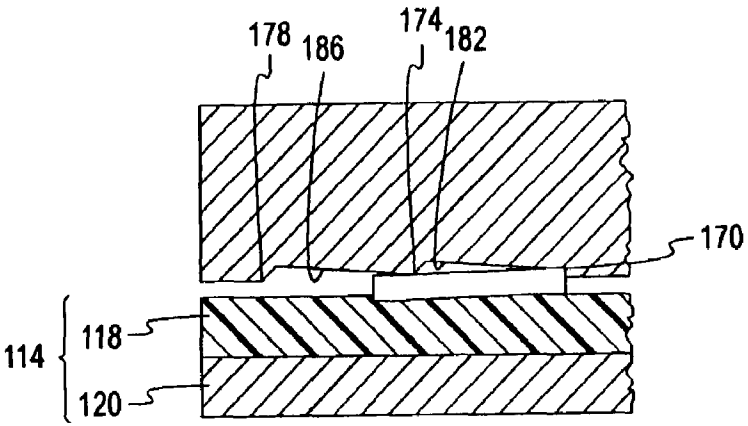
FIG. 3 is a cross-sectional view of the sorting head shown in FIG. 2 taken along line 3-3.

In FIG. 3, a small diameter coin (e.g., a dime or a 1¢ Euro coin) is shown pressed into resilient pad 118 by the first rail 174 of the sorting head 112. The rails 174, 178 are dimensioned to be spaced away from the top of the resilient pad 118 by a distance less than the thickness of the thinnest coin so that the coins are gripped between the rail 174, 178 and the resilient pad 118 as the coins move through the queuing channel 166. The coins are actually slightly tilted with respect to the sorting head 112 such that their outermost edges are pressed into the resilient pad 118. Consequently, due to this positive pressure on the outermost edges, the innermost edges of the coins tend to rise slightly away from the resilient pad 118.

Referring back to FIG. 2, the coins are gripped between one of the two rails 174, 178 and the resilient pad 118 as the coins are rotated through the queuing channel 166. The coins, which were initially aligned with the outer wall 136 of the entry channel 130 as the coins moved across the ramp 162 and into the queuing channel 166, are rotated into engagement with inner queuing wall 170. Because the queuing channel 166 applies a greater amount of pressure on the outside edges of the coins, the coin are less likely to bounce off the inner queuing wall 170 as the radial position of the coin is increased along the inner queuing wall 170.

Figure 4B:
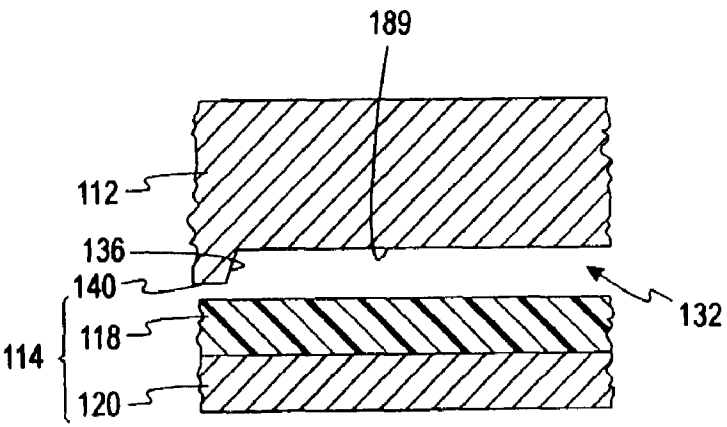
FIG. 4*b* is a cross-sectional view of an alternative embodiment of that which is shown in FIG. 4*a;*
Figure 4A:
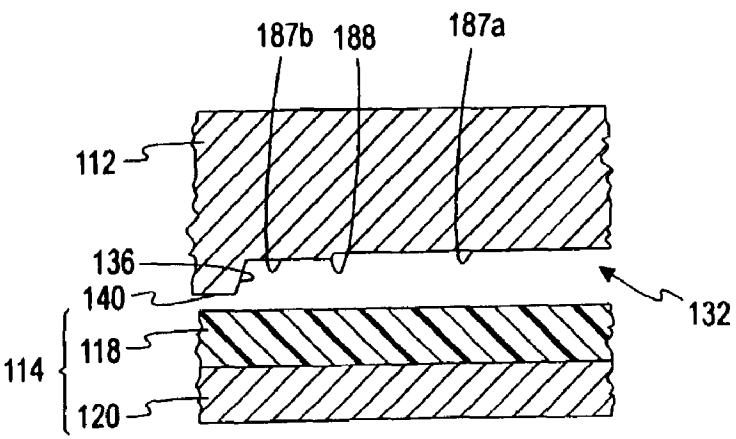
FIG. 4*a* is a cross-sectional view of the sorting head shown in FIG. 2 taken along 4-4.

Referring to FIG. 4*a*, the entry region 132 of the embodiment of the sorting head 112 shown in FIG. 2 includes two stepped surfaces 187*a*, 187*b* forming a rail 188 therebetween. According to an alternative embodiment of the sorting head 112, the entry channel 132 consists of one surface 189 as shown in FIG. 4*b*.

Figure 5:
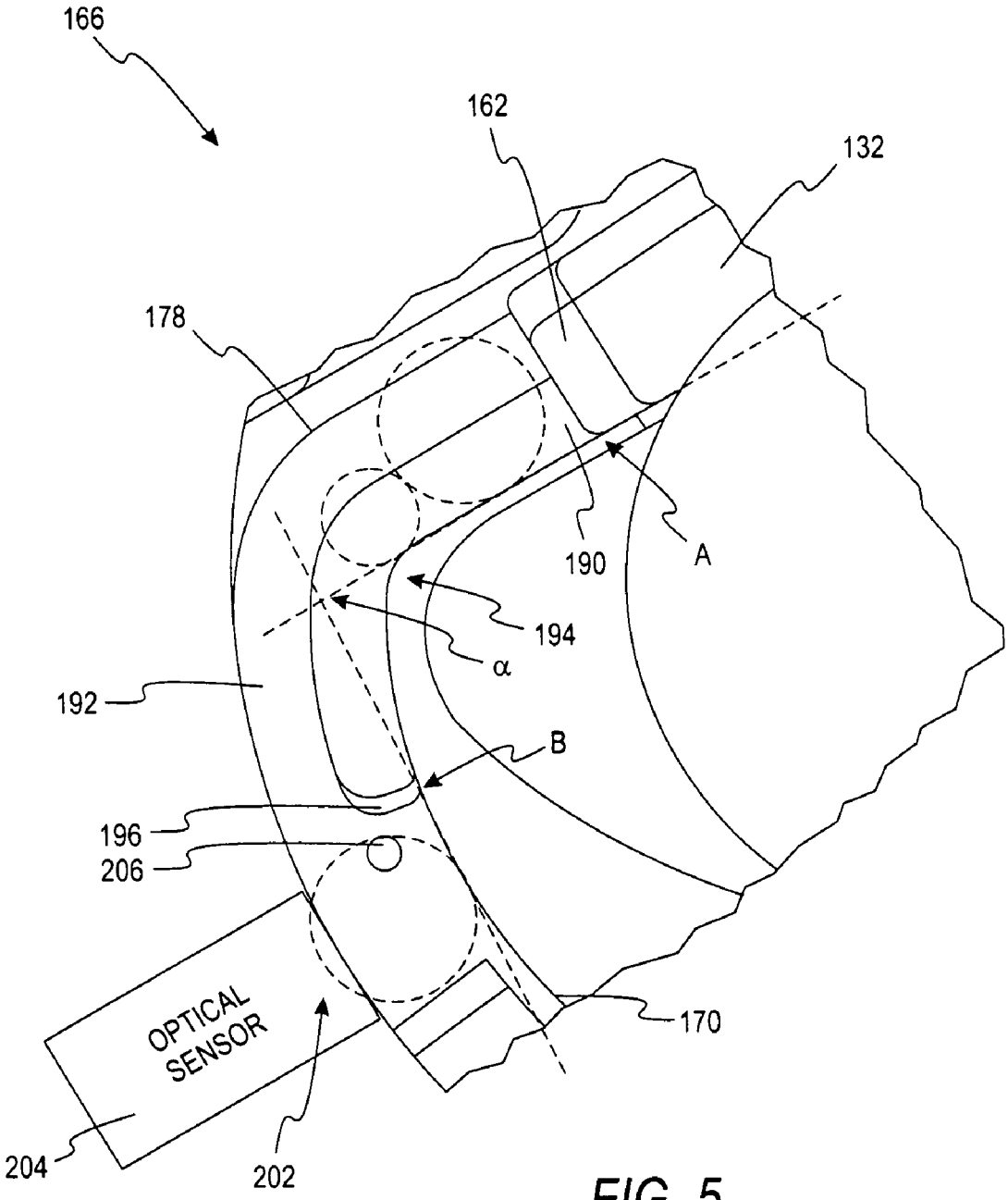
FIG. 5 is an oversize view of a queuing channel of the sorting head shown in FIG. 2.

Referring now to FIG. 5, there is shown an oversized view of the queuing channel 166 of FIG. 2. It can be seen that the queuing channel 166 is generally "L-shaped." The L-shaped shaped queuing channel 166 is considered in two segments—a first upstream segment 190 and a second downstream segment 192. The upstream segment 190 receives the coins as the coins move across the ramp 162 and into the queuing channel 166. The coins enter the downstream segment 192 as the coins turn a corner 194 of the L-shaped queuing channel 166. As the resilient pad 118 rotates, the coins move along the second segment 192 and are still engaged on the inner queuing wall 170. The coins move across a ramp 196 as the coins enter a discrimination region 202 and a reject region having a reject channel 212 for off-sorting invalid coins, which are both located towards the downstream end of the second segment 192. The discrimination region includes a discrimination sensor 204 for discriminating between valid and invalid coins and/or identifying the denomination of coins.

The queuing channel 166 is designed such that a line tangent to the inner queuing wall 170 of the L-shaped queuing channel 166 at about the point where coins move past the ramp 196 into the discrimination region 202 (shown as point A in FIG. 5) forms an angle alpha ($\alpha$) with a line tangent to the inner queuing wall 170 at about the point where coins move over ramp 162 into the queuing channel 166 (shown as point B in FIG. 5). In one aspect, the angle alpha ($\alpha$) is about 100°. In other aspects of the coin processing system 100, the angle alpha ($\alpha$) ranges between about 90°-110°.

As the resilient pad 118 rotates, the L-shaped of the queuing channel 166 imparts spacing to the coins which are initially closely spaced, and perhaps abutting one another, as the coins move across the ramp 162 into the queuing channel 166. As the coins move along the first upstream segment 190 of the queuing channel 166, the coins are pushed against inner queuing wall 170 and travel along the inner queuing wall 170 in a direction that is transverse to (i.e., generally unparallel) the direction in which the resilient pad 118 is rotating. This action aligns the coins against the inner queuing wall 170.

As the coins pass corner 194 and move into the second downstream segment 192 of the queuing channel 166, the coins are turned in a direction wherein they are moving with the pad (i.e., in a direction more parallel to the direction of movement of the pad). Coins are accelerated by the resilient pad 118 as they pass the corner 194 and are thereby spaced apart from successive coins as the coins move through the second segment 192. In one aspect of the present concepts, the coins are spaced apart by a time of approximately five milliseconds when the sorting head 112 has an eleven inch diameter and the resilient pad 118 rotates at a speed of approximately three hundred revolutions per minute (300 r.p.m.). In another aspect, the coins are spaced apart by a distance of less than about two inches when the sorting head 112 has an eleven inch diameter and the resilient pad 118 rotates at a speed of about 350 r.p.m.

Referring back to FIG. 2, the rotation of resilient pad 118 causes the coins to move across ramp 196 into the discrimination region 202 of a second segment 194, where the stepped surfaces 182, 186 of the queuing channel 166 transition into flat surfaces. The resilient pad 118 holds each coin flat against these flat surfaces of the discrimination region 202 as the coins move past the coin trigger sensor 206 and coin sensor 204 in the downstream second segment 194. The coin trigger sensor 206 is disposed just upstream of the discrimination sensor 204 for detecting the presence of a coin. Movement of a coin over, under, or adjacent the coin trigger sensor 206 (e.g., a photo detector or a metal proximity detector), as applicable, sends a signal to a controller 280 indicating that a coin is approaching the coin sensor 204.

Coin discrimination sensors suitable for use with the disc-type coin sorter shown in FIGS. 1 and 2 are describe in detail in U.S. Pat. Nos. 5,630,494 and 5,743,373, both of which are entitled "Coin Discrimination Sensor And Coin Handling System" and are incorporated herein by reference in their entirety. Another coin discrimination sensor suitable for use with the present invention is described in detail in co-pending U.S. patent application Ser. No. 10/095,256 (Attorney Docket No. 47171-00361USPT) entitled "Sensor And Method For Discriminating Coins Of Varied Composition, Thickness, And Diameter," filed on Mar. 11, 2002, which is incorporated herein by reference in its entirety.

The sorting head is designed to impart spacing to adjacent coins and is configured to move coins so that at least a portion of an outside edge of each of the coins extends beyond an outer periphery 207 of the sorting head 112 over a portion of the coins travel. This positioning of the portion of an outside edge of each coin disposes such portion of the coins in the sensing area of a sensor 204, such as but not limited to an optical sensor, that is itself disposed such that its sensing area is outside of the outer periphery 207 of the sorting head 112. The sensor 204 is configured to discriminate an invalid coin from a valid coin, to discriminate between the various denominations of coins, and/or to particularly identify the denomination of coins. The sensor 204 can comprise, for example, a photo-detector, a charge-coupled device (CCD) detector, a metal oxide semiconductor (MOS) array, a line array, a camera, a scanning laser or other type of optical sensor according to various alternative embodiments. The sensor 204 could also include other types of sensors including, but not limited to, ultrasonic or microwave sensors.

The radial position of the queuing channel 166 is moved outward a distance such that at least a portion of each coin, preferably a portion permitting measurement of a chord distance between a leading edge and a trailing edge of the coins, is moved beyond the outer periphery 207 of the sorting head 112 to obtain optical information from the coins. In one aspect, a diameter of the smallest coin to be processed (e.g., the dime in the U.S. coin set) is moved beyond the outer periphery 207 of the sorting head 112. In another aspect, the coins must extend beyond the outer periphery 207 of the sorting head 112 at least about 0.010 inch (approximately 0.25 mm) to permit the optical sensor 204 to obtain information from the coin.

A controller 280 of the coin processing system 100 processes the optical information obtained from each coin by the optical sensor 204. As the resilient pad 118 continues to rotate, the coin is brought back within the outer periphery 207 of the sorting head 112 as the coin moves past a diverting pin 210 and reject channel 212.

The diverting pin is disposed downstream of the discrimination sensor 204 and adjacent inner queuing wall 170. The diverting pin 210 is movable (e.g., translatable and/or rotatable) by an actuator to a diverting position (out of the page as viewed in FIG. 2) and a home position (into the page as viewed in FIG. 2). In the diverting position, the diverting pin 210 directs coins off of inner queuing wall 170 and into a reject channel 212. The reject channel 212 includes a reject wall 214 that rejected coins abut against as they are off-sorted to the periphery of the sorting head 112. Off-sorted coins are directed to a reject area (not shown).

As the resilient pad 118 rotates, valid coins continue along inner queuing wall 170. In the illustrated aspect of the sorting head 112, the inner queuing wall 170 and the queuing channel 166 terminate just downstream of the reject channel 212. In this aspect, the radial position of the coins is maintained, because the coins remain under pad pressure, until the coins contact and engage an outer wall 252 of a gauging region 250. The sorting head 112 may optionally include a gauging block 254 which extends the outer wall 252 beyond the outer periphery of the sorting head 112. The gauging block 254 is useful when processing larger diameter coins or tokens (e.g., 50¢ pieces) that may extend beyond the outer periphery of the sorting head 112. As shown in the embodiment of FIG. 2, the sorting head 112 gauging channel 250 may advantageously include two stepped surfaces to form rails 251, 253 similar to that described above in connection with the queuing channel 166. However, the gauging channel 250 does not require stepped surfaces or rails 251, 253, as shown in FIG. 2.

The outer wall 252 of the gauging channel 250 permits the coins to be aligned or registered on or along a common radius as the coins approach a series of coin exit channels 261-268 in a coin exit station area, as shown in FIG. 2. The coin exit channels 261-268 permit discharge coins of different denominations. The first exit channel 261 is dedicated to the smallest coin to be sorted (e.g., the dime in the U.S. coin set). Beyond the first exit channel 261, the depicted sorting head 112 forms additional exit channels 262-268 which discharge coins of different denominations at different circumferential locations around the periphery of the sorting head 112. Thus, the exit channels 261-268 are spaced circumferentially around the outer periphery of the sorting head 112 with the innermost edges of successive channels located progressively closer to the center of the sorting head 112 so that coins are discharged in the order of decreasing diameter. The number of exit channels can vary to accommodate different currency or token sets or mixes.

The innermost edges of the exit channels 261-268 are positioned so that the inner edge of a coin of only one particular denomination can enter each channel 261-268. The coins of all other denominations reaching a given exit channel extend inwardly beyond the innermost edge of that particular exit channel so that those coins cannot enter the channel and, therefore, continue on to the next exit channel under the circumferential movement imparted on them by the resilient pad 118. To maintain a constant radial position of the coins, the resilient pad 118 continues to exert pressure on the coins as they move between successive exit channels 261-268.

According to one embodiment of the sorting head 112, each of the exit channels 261-268 includes a coin counting sensor 271-278 for counting the coins as coins pass though and are discharged from the coin exit channels 261-268. In an embodiment of the coin processing system utilizing a discrimination sensor capable of determining the denomination of each of the coins, it is not necessary to use the coin counting sensors 271-278 because the discrimination sensor 204 provides a signal that allows the controller to determine the denomination of each of the coins. Through the use of the system controller (FIG. 6), a count is maintained of the number of coins discharged by each exit channel 261-268.

Figure 6:
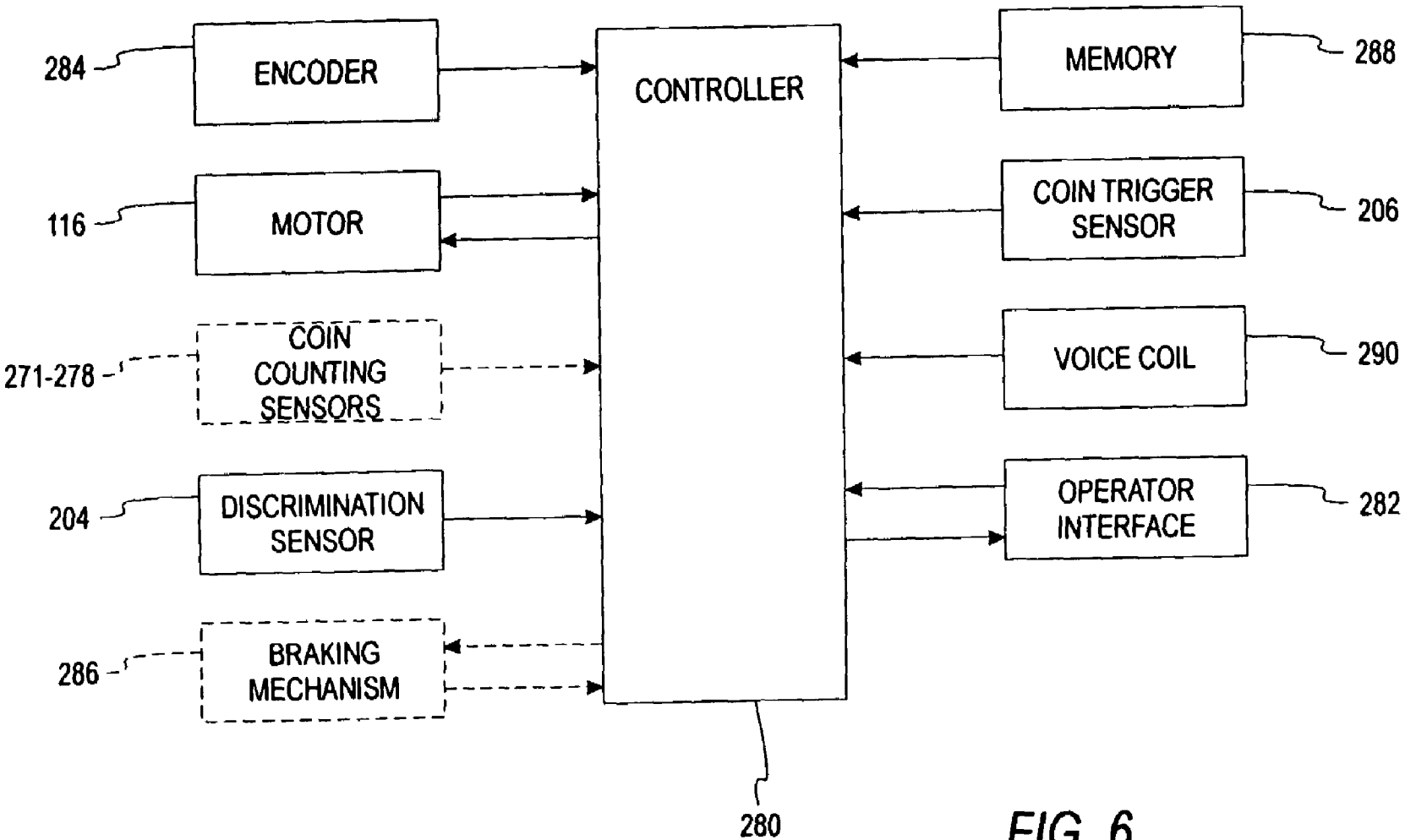
FIG. 6 is a functional block diagram of the control system for the a coin processing system shown in FIG. 1.

FIG. 6 illustrates a system controller 280 and its relationship to the other components in the coin processing system 100. The operator communicates with the coin processing system 100 via an operator interface 282 for receiving information from an operator and displaying information to the operator about the functions and operation of the coin processing system 100. The controller 280 monitors the angular position of the disc 114 via an encoder 284 which sends an encoder count to the controller 280 upon each incremental movement of the disc 114. Based on input from the encoder 284, the controller 280 determines the angular velocity at which the disc 114 is rotating as well as the change in angular velocity, that is the acceleration and deceleration, of the disc 114. The encoder 284 allows the controller 280 to track the position of coins on the sorting head 112 after being sensed. According to one embodiment of the coin processing system 100, the encoder has a resolution of 2000 pulses per revolution of the disc 114.

Furthermore, the encoder 284 can be of a type commonly known as a dual channel encoder that utilizes two encoder sensors (not shown). The signals that are produced by the two encoder sensors and detected by the controller 280 are generally out of phase. The direction of movement of the disc 114 can be monitored by utilizing the dual channel encoder.

The controller 280 also controls the power supplied to the motor 116 which drives the rotatable disc 114. When the motor 116 is a DC motor, the controller 280 can reverse the current to the motor 116 to cause the rotatable disc 114 to decelerate. Thus, a braking mechanism is not required, but may optionally be used.

According to one embodiment of the coin processing device 100, the controller 280 also monitors the coin counting sensors 271-278 which are disposed in each of the coin exit channels 261-268 of the sorting head 112 (or just outside the periphery of the sorting head 112). As coins move past one of these counting sensors 271-278, the controller 280 receives a signal from the counting sensor 271-278 for the particular denomination of the passing coin and adds one to the counter for that particular denomination within the controller 280. The controller 280 maintains a counter for each denomination of coin that is to be sorted. In this way, each denomination of coin being sorted by the coin processing system 100 has a count continuously tallied and updated by the controller 280. The controller 280 is able to cause the rotatable disc 114 to quickly terminate rotation after a "n" number (i.e., a predetermined number) of coins have been discharged from an output receptacle, but before the "n+1" coin has been discharged. For example, it may be necessary to stop the discharging of coins after a predetermined number of coins have been delivered to a coin receptacle, such as a coin bag, so that each bag contains a known amount of coins, or to prevent a coin receptacle from becoming overfilled.

The controller 280 also monitors the output of coin discrimination sensor 204 and compares information received from the discrimination sensor 204 to master information stored in a memory 288 of the coin processing system 100 including information obtained from known genuine coins. If the received information does not favorably compare to master information stored in the memory 288, the controller 280 sends a signal to an actuator 290 to move the diverting pin 210 to a diverting position.

According to one embodiment of the coin processing system 100, after a coin moves past the trigger sensor 206, the coin discrimination sensor 204 begins sampling the coin. The discrimination sensor 204 begins sampling the coins within about 30 microseconds ("μs") of a coin clearing the trigger sensor 206. The sampling ends after the coin clears a portion or all of the discrimination sensor 204. In one aspect, a coin's signature, which consists of the samples of the coin obtained by the discrimination sensor 204, is sent to the controller 280 after the coin clears the trigger sensor 206 or, alternatively, after the coin clears the discrimination sensor 204. As an example, when the coin processing system 100 operates as a speed of 350 r.p.m. and the sorting head 112 has a diameter of eleven inches, it takes approximately 3900 μs for a 1¢ Euro coin (having a diameter of about 0.640 inch) to clear the trigger sensor 206. A larger coin would take more time. In another aspect, a coin's signature data may be sent directly to the controller 280 upon sampling so that the controller 280 can incrementally analyze the data to speed processing time. The controller 280 may also use parallel or multiply-parallel processors to further enhance data processing speed.

The controller 280 then compares the coin's signature to a library of "master" signatures obtained from known genuine coins stored in the memory 288. The time required for the controller 280 to determine whether a coin is invalid is dependant on the number of master signatures stored in the memory 288 of the coin processing system 100. According to one embodiment of the present invention, there are thirty-two master signatures stored in the memory 288, while other embodiments may include any practical number of master signatures. Generally, regardless of the number of stored signatures and the particular configuration of the controller 280, the controller 280 determines whether to reject a coin in less than about 250 μs.

After determining that a coin is invalid, the controller 280 sends a signal to an actuator 290 to move the diverting pin 210 to the diverting position. As shown in FIG. 2, the diverting pin 210 is located about 1.8 inches downstream from the trigger sensor 206 on the eleven inch sorting head. Assuming an operating speed of 350 r.p.m., for example, the controller 280 activates the actuator 290 within about 7300 μs from the time that the coin crosses the trigger sensor 206. As discussed above, the actuator 290 is configured to rapidly (e.g., about 1300 μs) move the diverting pin 210 through a desired range of motion, such as but not limited to about ⅛".

For an example of an eleven inch sorting disc having an operational speed of 350 r.p.m. and a trigger sensor 206, discrimination sensor 204 and a diverting pin 210 arrangement as shown in FIG. 2, about 11 milliseconds elapses from the time a coin crosses the trigger sensor 206 until the diverting pin 210 is lowered to the diverting position. Thus, the diverting pin 210 is located less than about two inches downstream of the trigger sensor 206. Accordingly, the spacing between coins crossing the trigger sensor 206 is less than about two inches.

Once the diverting pin 210 is moved to the diverting position, the diverting pin 210 may optionally be configured to remain in the diverting position until a valid coin is encountered by the discrimination sensor 204. In this configuration, the diverting pin 210 will only need to be moved to the diverting position one time when three invalid coins in a row are detected. This may be particularly beneficial in applications involving a heavy mix of valid and invalid coins. If the fourth coin is determined to be a valid coin, the diverting pin 210 is moved to its home position. In accord with other aspects of the disclosed coin processing system 100, the diverting pin 210 is moved to the home position if the trigger sensor 206 sensor does not detect a coin within about two seconds of the last coin that was detected by the trigger sensor 206, which can occur when a batch of coins being processed in nearing the end of the batch. This reduces wear and tear on the resilient pad 118, which is rotating beneath the diverting pin 210, because the diverting pin 210 and the rotating resilient pad 118 are in contact when the diverting pin 210 is in the diverting position.

The spacing imparted to the coins via the L-shaped queuing channel 166 provides, in combination of a fast-acting actuator driving discriminator pin 210, permits the disclosed coin sorter system 100 illustrated in FIGS. 1 and 2 to be able to discriminate coins without stopping rotatable disc 120 and/or without slowing down of the rotatable disc 120.

In general, a resilient pad for a disc-type coin processing machine in accord with the present concepts includes a first portion of the resilient pad having a first property and a second portion of the resilient pad having a second property, wherein the second property is different than the first property. Providing different properties in different portions of the resilient pad provides variability where none previously existed and permits tailoring of the resilient pad properties to better suit the particular problems associated with different parts of the resilient pad and/or the disc-type coin processing machine. The property may include any property including, for example, bulk properties, local properties, and surface properties. The bulk property and local property may include, for example, stiffness or modulus. The surface property may include, for example, a coefficient of friction. The different properties in the different portions of the resilient pad may comprise entirely separate portions with a clear demarcation therebetween or may comprise a rate of change in the property (e.g., linear, non-linear, continuous, intermittent, non-uniform, etc.) across different portions of the resilient pad, in which case the first portion and the second portion may comprise different regions having different ranges of the property of interest.

Figure 7A:
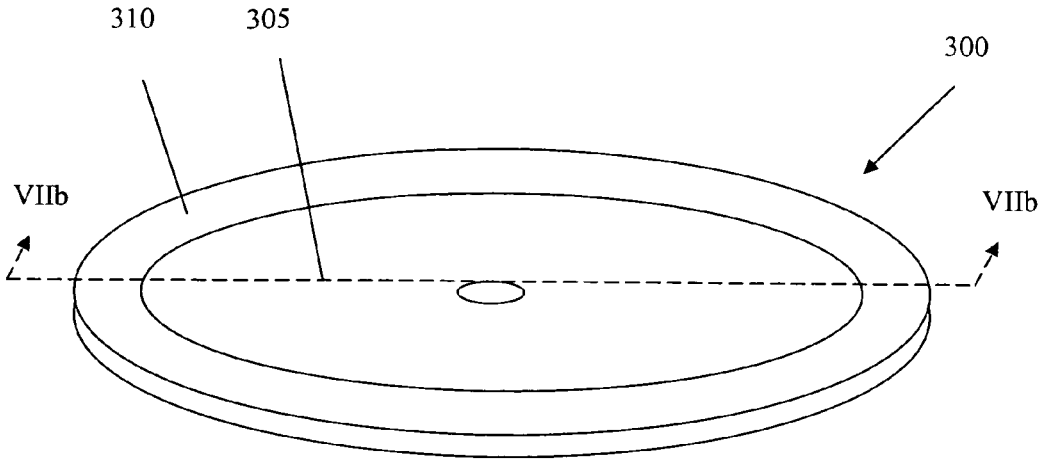
FIGS. 7*a*-7*b* respectively show an isometric and a cross-sectional view of a resilient pad and a protective layer for a resilient pad in accord with the present concepts.
Figure 7B:
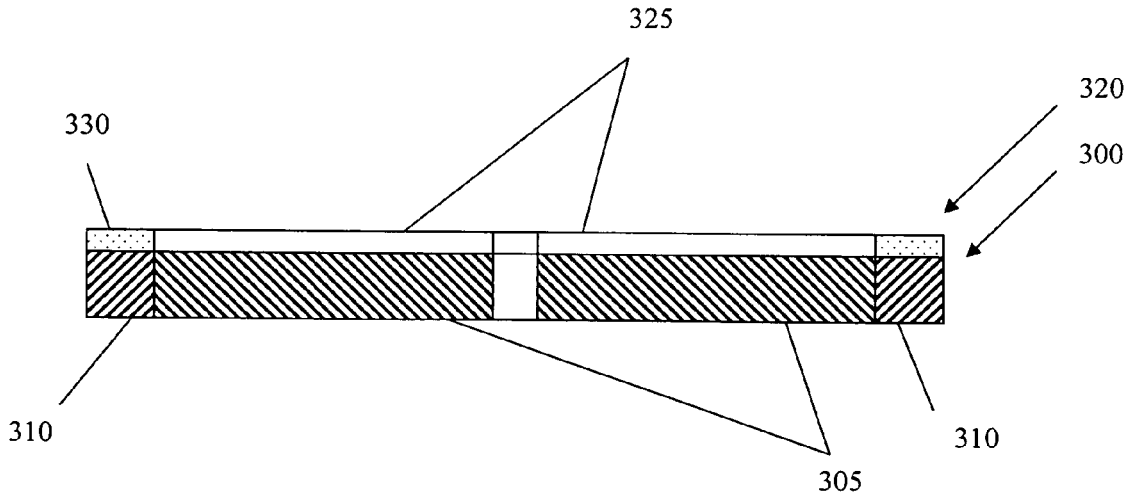

In the example of FIGS. 7*a*-7*b*, a resilient pad 300 in accord with one aspect of the present concepts is shown mounted to an upper surface of a rotatable disc 312. Resilient pad 300 comprises a first portion 305 and a second portion 310. In this example, the first portion is a central portion (hereinafter "central portion 305") and the second portion is an outer peripheral portion (hereinafter "outer peripheral portion 310"). The cross-hatching of the central portion 305 and the outer peripheral portion 310 are different, reflecting the different properties of the central portion 305 and the outer peripheral portion 310, which difference in properties may arise from the use of different materials for the central portion 305 and outer peripheral portion 310 or may arise from the use of different processing techniques or treatments of a similar or the same material for each of the central portion 305 and the outer peripheral portion 310. For example, the stiffness of the central portion 305 may be different than (i.e., higher or lower) than that of the outer peripheral portion 310.

In one aspect, the central portion 305 and outer peripheral portion 310 may comprise an elastomer, a rubber, or a sponge rubber. The central portion 305 may comprise, for example, a natural open cell sponge rubber such as, but not limited to a Groendyk® Manufacturing Co., Inc. No. 561-C or Griswold Rubber Co. No. 3110. This natural open cell sponge rubber has density of about 22 pounds/ft$^3$ and have a 25% compression deflection at about 2-5 psi. The outerperipheral portion 310 may comprise, for example, a natural open cell sponge rubber such as, but not limited to a Groendyk® Manufacturing Co., Inc No. 563-C or Griswold Rubber Co. No. 3130. This natural open cell sponge rubber has density of about 30 pounds/ft$^3$ and have a 25% compression deflection at about 10-16 psi.

Although the example of FIGS. 7*a*-7*b* shows a resilient pad 300 with two portions (e.g., central portion 305 and outer peripheral portion 310) having different properties (e.g., stiffness, coefficient of friction, etc.), the present concepts are not limited thereby and may include a plurality of portions (e.g., between 3 and 20, inclusive, etc.) having different properties. For example, a third portion comprising a resilient material having a third property (e.g., stiffness) may be provided, such third property optionally being greater than or less than either of the corresponding property in the first or second portions. Moreover, a resilient pad in accord with the present concepts may comprise any number of sections or portions having different bulk, local, or surface properties to enhance the ability of a disc-type coin sorting machine employing such pad to grip a coin between the resilient pad and a disc-type coin sorting machine stationary sorting head.

The geometry of the portions having different properties may be similar to that of the other portions (e.g., each having an annular shape) or they may assume different geometric or polygonal, symmetric, asymmetric, linear, or curvilinear shapes. The curvilinear shapes may include any curve and may include, for example, spirals (e.g., logarithmic spirals, Archimedean spiral, etc.). Although the example of FIGS. 7*a*-7*b* shows that the properties of the first portion (e.g., central portion 305) and the second portion (e.g., outer peripheral portion 310) are uniform through the thickness of the resilient pad 300, the different properties of the first portion and the second portion may be provided in or at any depth and may comprise any thickness. Such first and second portions, and/or additional portions, may be provided at or near an upper surface of the resilient pad 300, between an upper surface and a lower surface of the resilient pad, or at or near an lower surface of the resilient pad. The first portion or the second portion may also comprise a raised portion, such as a relief, or a depressed portion, such as a dimple.

In one example, the second portion may comprise a plurality of discrete shapes having a predetermined thickness (e.g., about ¼ of the thickness of the resilient pad 300) being distributed about an upper surface of the resilient pad, an upper surface of the second portion being substantially coplanar with an upper surface of the resilient pad. In another aspect, the second portion may comprise a plurality of discrete shapes having a predetermined thickness (e.g., about ⅓ of the thickness of the resilient pad 300), such as material inserts, being distributed between the upper and lower surfaces of the resilient pad. Protective layer 320 may also comprise first and second portions, and/or additional portions, provided at or near an upper surface thereof, between an upper surface and a lower surface thereof, or at or near an lower surface thereof.

In accord with the example of FIGS. 7*a*-7*b*, an increased stiffness of the outer peripheral portion 310 (or portion thereof) of resilient pad 300 permits application of a greater normal force to coins held between the stationary sorting head (e.g., 112) and the rotating resilient pad 300. This is advantageous, in the example of FIG. 2, wherein portions of coins are displaced outside of a periphery 207 of the resilient pad and sorting head 112, as they are rotated at appreciable velocities, to permit sensing by an external sensor 204. The increased normal force attributable to an increase in the stiffness of the resilient pad over at least a portion of the periphery thereof helps the resilient pad to grip and retain the coins in position, in combination with the sorting head, during movement of the coins past and beyond sensor 204.

An increased normal force may also be accomplished by increasing the coefficient of friction of at least a portion of the outer peripheral portion 310 of the resilient pad 300. The increased coefficient of friction may be achieved by applying a material or coating to resilient pad 300 or integrating a material or coating into the resilient pad 300. Such material or coating may be continuously distributed, variably distributed, or intermittently disposed. In the latter case, it would be desirable to have spaces between the intermittent sections of such disposed or applied material or coating having a length less than that of the smallest coin or token to be processed to ensure at least some engagement between the coin and the portion of the outer peripheral portion 310 having the increased coefficient of friction. The increased coefficient of friction may be implemented in combination with the various aspects of resilient pads disclosed herein, or may be separately implemented as an improvement to conventional resilient pads, which provide a uniform material having a substantially uniform stiffness throughout.

The resilient pad 300 is, in one aspect, about 11.00 inches in diameter and about 0.31 inches thick. In the illustrated example, the resilient pad 300 central portion 305 comprises a first annulus and the outer peripheral portion 310 comprises a second annulus. In one aspect of the present concepts, the central portion 305 has a diameter of about 10.00 inches and the outer peripheral portion has an inner diameter of about 10.00 inches and an outer diameter of about 11.00 inches. An opening may be optionally provided in a center of the resilient pad 300 to permit centering of the resilient pad 300 to an underlying rotatable disc. Other conventional registration techniques may also be used to position the resilient pad 300 relative to an underlying rotatable disc 312.

FIG. 7*b* shows an optional protective layer 320 disposed over the central portion 305 and outer peripheral portion 310 of the resilient pad 300. As with FIG. 7*a*, the resilient pad 300 is shown mounted on top of a disc 312. The protective layer 320 may comprise, in various aspects, a wear-resistant fabric, a wear-resistant elastomer, and/or a wear-resistant polymer. The protective layer 320 may be uniform or may comprise a first portion such as, but not limited to a central portion 325, and a second portion such as, but not limited to an outer peripheral portion 330, having different materials and/or properties (e.g., coefficient of friction, thickness, stiffness or resilience, etc.). The protective layer 320 may be affixed to the resilient pad 300 by thermal curing, by chemical bonding, adhesive (e.g., 3M-950 adhesive), lamination, or any other conventional bonding technique or material or suitable mechanical fastener. Protective layer 320 may itself comprise a first portion and a second portion having different properties. The protective layer 320 may include, for example, a central portion 325 and an outer peripheral portion 330 comprising one or more materials having a different property (e.g., a higher or lower stiffness or coefficient of friction). The first and second portions of the protective layer 320 having different properties may optionally spatially correspond to respective one of the first and second portions (e.g., central portion 305 and outer peripheral portion 310) having different properties of the underlying resilient pad 300.

Figure 8A:
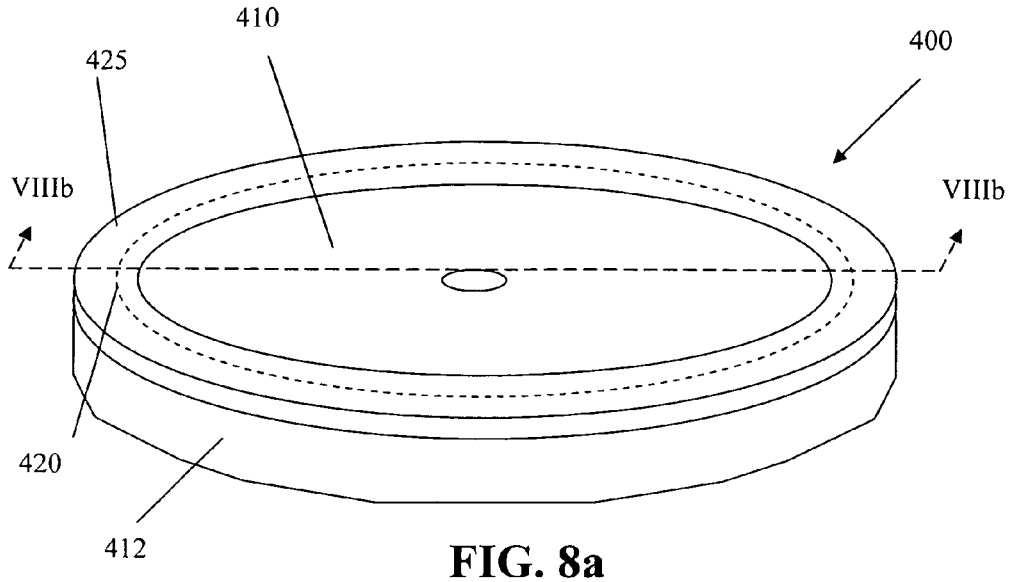
FIGS. 8*a*-8*c* respectively show an isometric view and cross-sectional views of resilient pads in accord with another aspect of the present concepts.
Figure 8B:
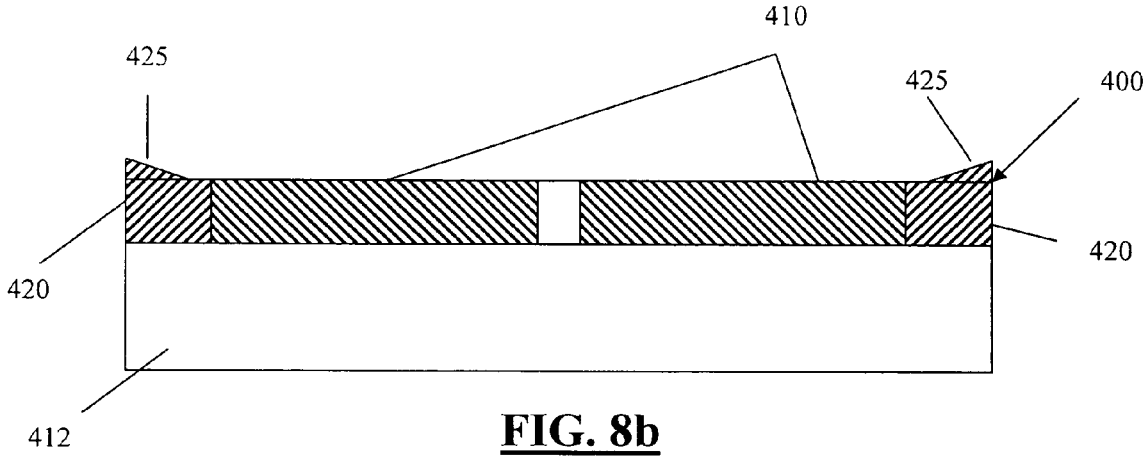

In yet another embodiment, shown in FIGS. 8*a*-8*b*, a resilient pad 400 for a disc-type coin processing machine is attached to an upper surface of a rotatable disc 412 and is provided which comprises a first portion 410 having a first thickness and a second portion 420 having, over at least a portion 425 thereof, a second thickness different than (e.g., greater as shown) the first thickness. The first portion 410 may comprise, for example, a central portion of the resilient pad 400 and the second portion 420 may comprise, for example, an outer peripheral portion of the resilient pad. The thickness of the respective first portion 410 or second portion 420 may vary linearly or non-linearly. The first portion 410 and second portion 420 of the resilient pad 400 advantageously comprise a resilient rubber, elastomer, and/or polymer.

In the example of FIGS. 8*a*-8*b*, the first portion 410 is a central portion (hereinafter "central portion 410") in the form of a disc or annulus and the second portion 420 is an outer peripheral portion (hereinafter "outer peripheral portion 420") comprises an annulus in which the central portion 410 is disposed. The section 425 of the outer peripheral portion 420 having an increased thickness may be annular in shape and is preferably, but not necessarily, disposed adjacent an outer edge of the resilient pad. The section 425 of increased thickness may also comprise one or more arcs of any predetermined angle of the resilient pad 400 adjacent an outer edge thereof.

Figure 8C:
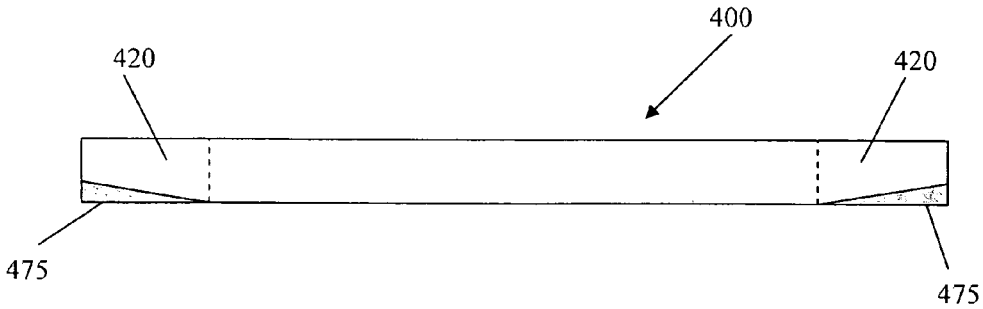

As noted above, the thickness of the central portion 410 and/or the outer peripheral portion 420 may vary over at least a portion thereof. In the example of FIG. 8*b*, the thickness of the outer peripheral portion 420 increases substantially linearly between an inner edge 421 of the outer peripheral portion 420 to an outer edge 422 of the outer peripheral portion, or along a portion thereof. The thickness of section 425 may also increase in a substantially curvilinear manner between an inner edge 421 of the outer peripheral portion 420 to an outer edge 422 of the outer peripheral portion, or along a portion thereof. In an alternative embodiment, shown in FIG. 8*c*, the thickness of the resilient pad 400 is decreased with increasing radius along an outer peripheral portion 420 and a shim or shims 475 are placed beneath the reduced thickness section to support the outer peripheral portion 420. The shim may comprise for example, a hard rubber, a metal, metal alloy, composite material, polymer, or plastic. The shim 475 permits alteration of characteristics of the outer peripheral portion 420. The shim 475, as well as the varying or varied thickness of the resilient pad 400, may comprise any shape or profile. A linear profile is depicted in FIG. 8*c*, but the disclosed aspects are not limited thereto and may assume, for example, a non-linear shape or profile. Alteration of the thickness of the resilient pad in the manner shown in FIG. 8*c* decreases the stack height of the material of the outer peripheral portion 420, which is believed to influence the compression characteristics thereof not only at full compression, but at lesser compressions thereof, thus generally increasing the stiffness of the outer peripheral portion.

In accord with the example of FIGS. 8*a*-8*c*, the thickness of the outer peripheral portion 310 (or portion thereof) of resilient pad 300 is varied. As show, the thickness varies or increases with increasing radius from the center of the resilient pad 400. This varying thickness provides, when compressed by an incident coin, a greater compression and hence greater normal force than would be achieved using a flat resilient pad. Thus, the normal force generated by the resilient pad in accord with the present concepts may be varied not only by selection of material and/or surface properties, but also by varying the geometry of the outer peripheral portion. As noted above, the ability to tailor the normal force of the resilient pad over at least a portion of the periphery thereof helps to grip and retain the coins in a desired position during rotation of the resilient pad, particularly when at least a portion of the coins are disposed outside of the periphery of the resilient pad during movement of the coins past and beyond an external coin sensor.

Figure 9A:
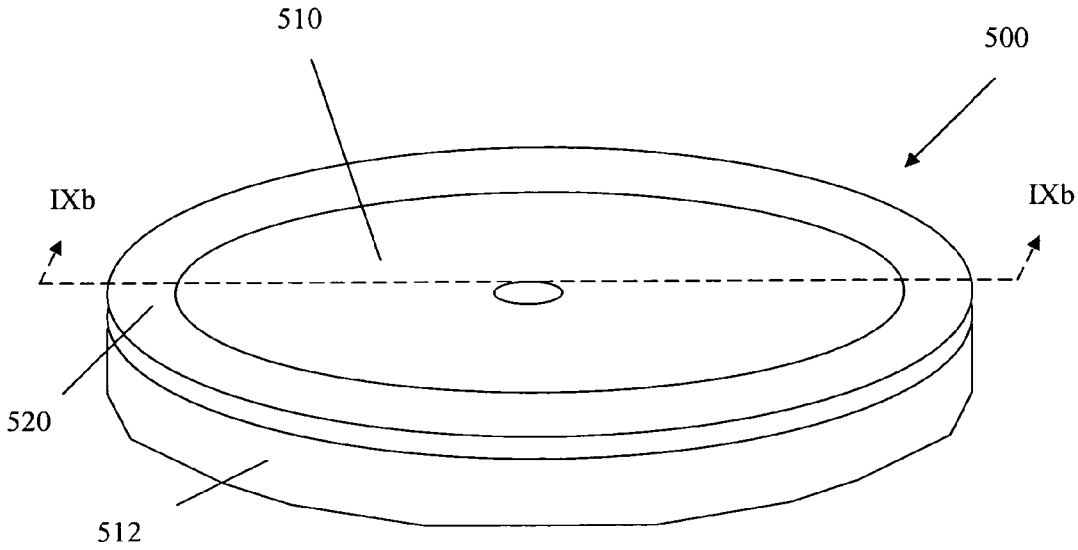
FIGS. 9*a*-9*b* respectively show an isometric and a cross-sectional view of a protective layer for a resilient pad in accord with the present concepts.
Figure 9B:
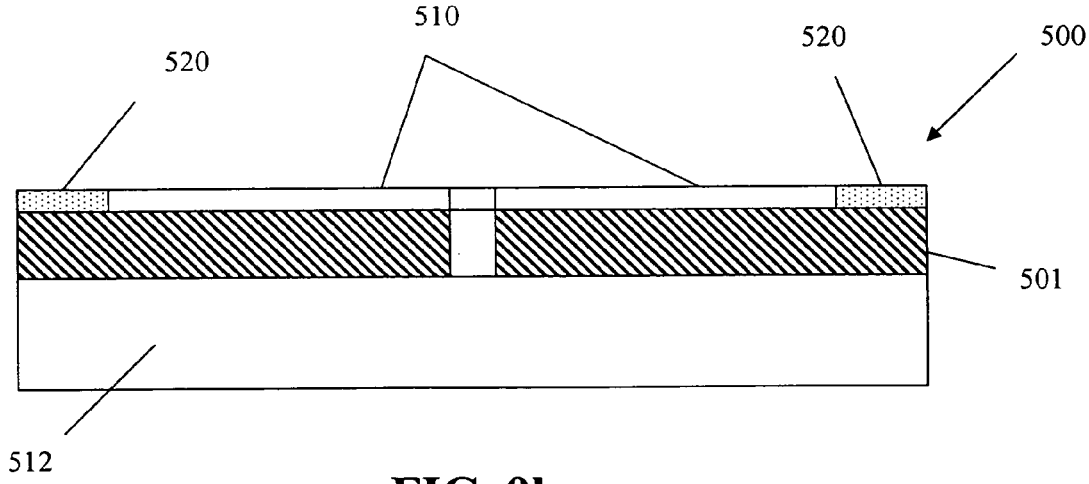

The stiffness of the resilient pad in accord with the aforementioned embodiments may also be selectively altered by modification of the conventional protective layer attached to and/or disposed over conventional resilient pads. Whereas conventional protective layers are uniform in material and properties (e.g., along a radius of the resilient pad), a protective layer or skin 500 in accord with the present concepts may itself comprise a central portion 510 and an outer peripheral portion 520, as shown in FIGS. 9*a*-9*b*. The protective layer 500 is disposed on a resilient pad 501, which is disposed in turn upon an upper surface of a rotatable disc 512. The central portion 510 and the outer peripheral portion 520 each possess different properties, but generally comprise, on at least an upper surface thereof, a wear-resistant fabric, elastomer, and/or polymer. The protective layer 500 also comprises a backing material including, but not limited, to an adhesive, bonding agent, or material suitable for thermally bonding with an underlying resilient pad material.

In accord with the above-noted aspects of the resilient pad (e.g., 300, 400), the protective layer 500 may comprise a resilient base material including a central portion 510 and outer peripheral portion 520 with materials having a different stiffness. Thus, the protective layer 500 itself may have an outer peripheral portion 520 having a greater stiffness than that of the central portion 510. The increased stiffness of the outer peripheral portion 520 may be accomplished, for example, by replacing the conventional material (e.g., a rubber) in such location with a material having a higher stiffness. For example, a Shore "A"-type rubber could be replaced with a Shore "C"-type rubber or a silicone rubber could be replaced by another silicone rubber having a greater hardness value (e.g., by altering a blended polymer base, filler, and/or additive used in the processing thereof or by altering curing conditions).

The stiffness of a portion of the protective layer (e.g., an outer peripheral portion 520 or portion thereof) may also be achieved, in one aspect, by slightly increasing the overall thickness of the protective layer 500 over such portion. The increased thickness may be accommodated by correspondingly increasing the spacing between the resilient disc and the stationary head. Since the resilient base material of the protective layer 500 typically has a greater stiffness than the material of the resilient pad itself (e.g., a rubber vs. a sponge rubber), increasing the thickness of the protective layer 500 will increase a stiffness of the combined resilient pad and protective layer.

The protective layer 500 outer peripheral portion 520 may also advantageously comprise materials or coatings imparting different coefficients of friction, such as to provide the outer peripheral portion 520 with a higher coefficient of friction than that of central portion 510 of the protective layer 500.

In one aspect, the central portion 510 and an outer peripheral portion 520 may correspond to or cover a respective one of the central portion (e.g., 305) and an outer peripheral portion (e.g., 310) of a resilient pad (e.g., 300). The central portion 510 and outer peripheral portion 520 may also be staggered relative to a respective one of a central portion (e.g., 305) and an outer peripheral portion (e.g., 310) of a resilient pad (e.g., 300). As shown in FIG. 9*b*, the protective layer 500 comprising a central portion 510 and an outer peripheral portion 520 is alternatively provided as a stand-alone improvement to a conventional resilient pad 501 having uniform properties. In still another aspect, a disc-type coin processing machine for processing a plurality of coins of mixed denominations may comprise a stationary sorting head having a lower surface opposing and spaced apart from the rotatable disc, as described above, wherein the lower surface of the sorting head comprises features (e.g., depressions, protrusions, obstacles, finishes, etc.) forming a coin path for biasing coins to an outer periphery of the sorting head such that a portion of each coin extends beyond the outer periphery of the sorting head in at least a sensing area having a coin sensor. The stationary sorting head may include a removable member disposed in the sensing area, the removable member having a dynamic coefficient of friction higher than that of the surrounding portions of the stationary head lower surface. The removable member may be attached to or integrated with the stationary sorting head using any conventional type of removable or releasable mechanical connection. The removable member may comprise, for example, one or more of a sintered metal and a sintered metal-ceramic, a woven material, a rubber, an elastomer, a sponge rubber, a molded material, a graphitic material, a resin-cured paper material, a polymeric material, and a metal having a roughened surface. The removable member may comprise one or more thin radial strips, one or more arcuate sections, an annulus, or some other shape. In still another aspect, the removable member disposed in the sensing area may advantageously be provided with a dynamic coefficient of friction lower than that of the surrounding portions of the stationary head lower surface. In both of these aspects, the removable member permits adjustment of the combined forces acting on the coins in the portion between a stiffer portion of the resilient pad and the removable member to provide an appropriate balance of normal forces acting on the coins and retarding frictional forces thereon.

While the invention is susceptible to various modifications and alternative forms, specific embodiments have been shown by way of example in the drawings and described in detail herein. It should be understood, however, that the invention is not intended to be limited to the particular forms disclosed. Rather, the invention is to cover all modifications, equivalents and alternatives falling within the spirit and scope of the invention as defined by the appended claims.

What is claimed is:

1. A coin processing machine for processing a plurality of coins of mixed denominations, comprising:

a stationary sorting head; and a rotatable disk for imparting motion to the plurality of coins, the stationary sorting head having a lower surface generally parallel to and spaced slightly away from the rotatable disc, the lower surface of the stationary sorting head forming a queuing channel and a coin exit station, the queuing channel having an interior wall against which the coins abut, the queuing channel having a first segment for receiving coins and aligning the coins along the interior wall and a second segment for moving the coins to an outer periphery of the sorting head such that a portion of each coin extends beyond the outer periphery; and the rotatable disc including a resilient pad having a plurality of portions having at least one property having different values, said resilient pad comprising a first portion having a first stiffness and a second portion having a second stiffness different from the first stiffness, the second portion having a second stiffness being configured to provide a higher gripping force on coins disposed between the second portion of the resilient pad and the lower surface of the stationary sorting head than between the first portion of the resilient pad and the lower surface of the stationary sorting head.

2. The coin processing machine of claim 1, wherein said first portion of said resilient pad comprises a central portion of said resilient pad and said second portion of said resilient pad comprises an outer peripheral portion of said resilient pad.

3. The coin processing machine of claim 1, further comprising:

an optical sensor disposed outside the periphery of the sorting head for obtaining information from the portion of each coin extending beyond the periphery of the sorting head.

4. The coin processing machine of claim 1, further comprising:

a diverter disposed toward an end of the second segment, the diverter being moveable between a first position wherein coins remain along a coin path toward the coin exit station and a second position for diverting coins to a reject station, and a controller for moving the diverter from the first position to the second position in response to the optical information obtained by the optical sensor indicating a coin should not proceed to the coin exit station.

5. The coin processing machine of claim 1, wherein the resilient pad first portion comprises an annulus.

6. The coin processing machine of claim 3, wherein the information from the optical sensor determines the authenticity of each coin.

7. The coin processing machine of claim 3, wherein the information from the optical sensor determines the denomination of each coin.

8. The coin processing machine of claim 1, wherein the exit station includes a plurality of exit channels for sorting coins by denomination.

9. The coin processing machine of claim 1, wherein the sorting head includes a gauging channel for aligning coins along a common radius prior to the plurality of exit channels.

10. The coin processing machine of claim 1, wherein at least one of said central portion and said outer peripheral portion of the resilient pad comprises at least one of a rubber, a sponge rubber, and an elastomer.

11. A coin processing machine for processing a plurality of coins of mixed denominations, comprising:

a rotatable disc for imparting motion to the plurality of coins, the rotatable disc including a resilient pad with a central portion and an outer peripheral portion, the outer peripheral portion comprising a first portion having a higher stiffness than the central portion;

a stationary sorting head having a lower surface generally parallel to and spaced slightly away from the rotatable disc, the lower surface forming a coin path leading to a coin exit station to which coins are discharged, the coin path moving the coins toward an outer periphery such that a portion of each coin extends beyond the outer periphery, while engaging said first portion of said resilient pad;

a sensor disposed outside the periphery of the sorting head for obtaining information from the portion of each coin extending beyond the periphery of the sorting head.

12. The coin processing machine of claim 11, further comprising a diverter disposed within said coin path and rotationally downstream of the sensor, the diverter being moveable between a first position allowing coins to remain in the coin path and a second position for diverting coins toward a reject station.

13. The coin processing machine of claim 12, further comprising a controller for moving the diverter from the first position to the second position in response to the information obtained by the sensor.

14. The coin processing machine of claim 11, wherein the sensor is an optical sensor.

15. The coin processing machine of claim 11, wherein the exit station includes a plurality of exit channels for sorting coins by denomination.

16. The coin processing machine of claim 15, wherein the sorting head includes a gauging channel for aligning coins along a common radius prior to the plurality of exit channels.

17. The coin processing machine of claim 11, wherein the information from the sensor determines at least one of the authenticity of each coin and the denomination of each coin.

18. A method of processing coins, comprising the acts of:

receiving the coins in a coin receiving region;

imparting motion to the coins with a rotatable disc comprising a resilient pad with a central portion and an outer peripheral portion, one or more portions of the outer peripheral portion having a higher stiffness than the central portion;

engaging the coins with a stationary sorting head during the act of imparting motion;

moving coins along a coin path within the stationary sorting head to a registering area adjacent a periphery of the sorting head; and gripping, in said registering area, at least a portion of each coin between the stationary sorting head and said one or more portions of the outer peripheral portion having a higher stiffness than the central portion.

19. The method of claim 18, further comprising the act of:

sensing a portion of each coin extending beyond said outside edge of the sorting head to determine a chord length of the coin.

20. The method of claim 19, further comprising the act of:

determining a denomination of each coin using the sensed chord length.

21. The method of claim 19, further comprising the act of:

determining an authenticity of each coin using information obtained from said act of sensing.

22. The method of claim 18, further comprising the act of:

increasing the spacing between adjacent coins prior to the act of sensing.

23. The method of claim 18, wherein less than half a diameter of each of the coins is exposed outside of a periphery of said sorting head.

24. A coin processing machine for processing a plurality of coins of mixed denominations, comprising:

a rotatable disc for imparting motion to the plurality of coins, the rotatable disc including a substantially rigid disc having a resilient pad disposed thereupon; and a stationary sorting head having a lower surface opposing and spaced apart from the rotatable disc, the lower surface of the sorting head comprising features forming a coin path for biasing coins to an outer periphery of the sorting head such that a portion of the coins extends beyond said outer periphery of the sorting head in at least a sensing area having a coin sensor;

wherein the stationary sorting head comprises a removable member disposed in the sensing area, the removable member having a coefficient of friction different than that of the surrounding portions of the stationary head lower surface, and wherein said removable member comprises a coefficient of friction higher than that of the surrounding portions of the stationary head lower surface.

25. A coin processing machine for processing a plurality of coins of mixed denominations according to claim 24, wherein said removable member comprises a coefficient of friction that varies along a predetermined direction.

26. A coin processing machine for processing a plurality of coins of mixed denominations according to claim 24, wherein said removable member comprises at least one of a sintered metal and a sintered metal-ceramic, a woven material, a rubber, an elastomer, a sponge rubber, a molded material, a graphitic material, a resin-cured paper material, a polymeric material, and a metal having a roughened surface.

* * * * *